US005508793A

United States Patent [19]

Kimura et al.

[11] Patent Number: 5,508,793

[45] Date of Patent: Apr. 16, 1996

[54] DEVELOPING DEVICE HAVING TONER RECYCLING MEANS AND TONER CONCENTRATION CONTROLLER

[75] Inventors: Takenobu Kimura; Yutaka Miyasaka, both of Tokyo, Japan

[73] Assignee: Konica Corporation, Tokyo, Japan

[21] Appl. No.: 195,171

[22] Filed: Feb. 14, 1994

[30] Foreign Application Priority Data

Feb. 15, 1993 [JP] Japan ..... 5-025711
Feb. 15, 1993 [JP] Japan ..... 5-025713

[51] Int. Cl.[6] ..... G03G 21/00

[52] U.S. Cl. ..... 355/246; 355/298

[58] Field of Search ..... 355/246, 208, 355/296, 298

[56] References Cited

U.S. PATENT DOCUMENTS

| | | | |
|---|---|---|---|
| Re. 33,484 | 12/1990 | Imanaka | 355/298 |
| 4,325,628 | 4/1982 | Torigai et al. | 355/298 X |
| 4,768,055 | 8/1988 | Takamatsu et al. | 355/298 |
| 4,894,688 | 1/1990 | Taniguchi et al. | 355/298 |
| 5,200,787 | 4/1993 | Nishiguchi | 355/298 |
| 5,231,458 | 7/1993 | Nishimura | 355/298 |
| 5,250,997 | 10/1993 | Kaneko et al. | 355/298 |
| 5,268,720 | 12/1993 | Saitoh et al. | 355/246 |
| 5,307,128 | 4/1994 | Murasaki et al. | 355/260 |

*Primary Examiner*—Robert Beatty
*Attorney, Agent, or Firm*—Finnegan, Henderson, Farabow, Garrett & Dunner

[57] ABSTRACT

A developing device has a developing unit to develop an electrostatic latent image formed on an image carrier surface with two-component developer composed of toner and carrier, a toner recycling device to feed toner removed from the image carrier surface by a cleaner back to the developing unit so as to recycle the removed toner, a supply member for supplying fresh toner to the developing device, and a toner concentration controller to control toner concentration in accordance with the result of a comparison between a reference signal that has been set, and a toner concentration of developer determined when the magnetic permeability of developer is detected by a toner concentration detection sensor disposed in the developing device. A drive source of the developing unit and that of the toner recycling device can be individually controlled. When a reference signal for the toner concentration sensor is to be set, a forcible idling operation is started in which the toner recycling device recycles toner to the developing device without the supply of fresh toner to the developing device by the supply member. Alternatively, the reference signal can be set when both the recycling device and supply member are inactive.

5 Claims, 14 Drawing Sheets

DEVELOPING DEVICE HAVING TONER RECYCLING MEANS AND TONER CONCENTRATION CONTROLLER

BACKGROUND OF THE INVENTION

The present invention relates to a developing device which makes an electrostatic latent image visible with developer, formed on an image carrier by means of electrophotographic recording or electrostatic recording. More particularly, the present invention relates to a toner concentration controller of a developing device in which dry type two-component developer is used, the toner concentration controller having a toner recycling means which recycles residual toner recovered from the surface of an image carrier by a cleaning means after transfer.

In an image recording apparatus such as an electrophotographic copier, a document is exposed to light so as to form an electrostatic latent image on the surface of an image carrier, then the electrostatic latent image is made visual by means of development, and the visual image is recorded on a recording sheet. Alternatively, in an image recording apparatus, an electric image signal is made visual, and the visual image is recorded on a recording sheet.

In this type image recording apparatus, two-component developer is used for the developing device so as to form a visual image, which is recorded on a recording sheet. In this two-component developer, toner is mixed with carrier at a predetermined mixing ratio. An amount of toner mixed with carrier is reduced as latent images are developed and recorded. When the toner amount is reduced, the density of recorded images is affected. Therefore, in order to obtain recorded images of a predetermined density, it is necessary to detect the toner concentration and to replenish toner when the toner concentration is reduced, that is, it is necessary to control the toner concentration in an appropriate range.

In this connection, in a developing device having a toner recycling means, recycled toner is supplied to an end portion of a developer conveyance screw so that new toner and recycled toner are stirred and mixed, and the mixed toner is conveyed to the development section.

In order to detect toner concentration, that is, in order to detect a mixing ratio of toner contained in developer, the following methods have been well known: a method in which the toner image density detected by a patch of reference density is optically detected; and an L (reactance) detection toner concentration sensor composed of a coil disposed to come into contact with developer so as to measure the permeability of developer.

According to the toner concentration detecting method in which the permeability is used for measurement, it is possible to detect the toner concentration at all times, and further the method is advantageous in that the image recording process is not changed for employing the method. According to the method, it is possible to maintain the toner concentration in an appropriate range when the detected toner concentration is compared with a toner reference value and a necessary amount of toner is replenished in accordance with the result of the comparison.

Concerning the L (reactance) detecting toner concentration sensor, for example, a toner concentration sensor referred to as a programmable toner sensor manufactured by TDK Co., Ltd. is known. The above toner concentration sensor is composed of an oscillation circuit including the aforementioned L coil, and a frequency-voltage conversion circuit. In this toner concentration sensor, the relation between toner concentration and output voltage is maintained to be negative characteristics in which: the higher the toner concentration, the lower the output voltage (shown in FIG. 10(A)). This L detection toner concentration sensor is provided with a control voltage input terminal. When a control voltage impressed upon this input terminal is changed, the output voltage of the concentration sensor can be adjusted.

FIG. 10(A) is a graph showing an example of the relation between control and output voltage in the L detection toner concentration sensor. FIG. 10(B) is a graph showing a change in the sensor output voltage with respect to the same toner concentration when control voltage is changed. In this case, the toner concentration is 5 weight percents.

[1] Initial reference value setting of the toner concentration sensor (1) Developer of the standard toner concentration (for example, 5 weight percents) is loaded in a developing device. Then, the developing device is installed in a process unit.

(2) Developer is stirred when the developing device is driven for 3 minutes. In this way, an amount of electrical charging of developer can be stabilized.

(3) Control voltage (Vc) is changed, and a voltage $V_{CO}$ is selected at which the output voltage ($V_T$) of the toner concentration sensor coincides with a control point (for example, 1.5 V shown in FIG. 10(A)).

[2] Toner concentration control

In a normal copy operation, the toner concentration sensor is controlled by the selected voltage $V_{CO}$. The lower the toner concentration, the higher the sensor output, and toner is supplied until the toner concentration sensor output voltage returns to the control point $V_{CO}$.

[3] Recycle toner

The initial reference value setting described above is conducted on the developer loaded into the developing device. Accordingly, in the case where the recycled toner has been returned from the cleaning unit in the above stage (2), the control voltage is selected under the condition that the toner concentration is increased by an amount of the recycled toner, and toner concentration control is conducted according to this toner concentration. Therefore, a mistaken toner concentration is stored in the developing device, so that an appropriate recording image density can not be provided.

The above problems are caused in the toner concentration control of the prior art.

SUMMARY OF THE INVENTION

The first object of the present invention is to provide a developing device in which the concentration of toner contained in developer is controlled. In this case, the developing device comprises: a toner recycling means for supplying recycling toner and new toner to a developing section; a toner concentration sensor for detecting the concentration of toner contained in developer when a change in the magnetic permeability of two-component developer composed of toner and carrier is detected; and drive means for controlling an amount of recycling toner returned to the developing section and also for controlling an amount of new toner supplied to the developing section. In this way, the developing device is capable of maintaining a reference toner concentration value when an initial reference value of toner concentration control is set in the developing device.

The second object of the present invention is to provide a developing device capable of always setting a predetermined reference toner concentration when only a small amount of toner is left in a toner recycling means or toner is completely removed from the toner recycling means in the case of routine inspection.

The first embodiment of the present invention is described as follows. The first embodiment is a developing device comprising: a developing means for developing an electrostatic latent image formed on an image carrier surface with two-component developer composed of toner and carrier; a toner recycling means for feeding toner removed from the image carrier surface by a cleaning means so as to recycle the toner; and a toner concentration control means for controlling toner concentration in accordance with the result of a comparison between a reference signal that has been set, and a toner concentration of developer determined when the magnetic permeability of developer is detected by a toner concentration detection sensor disposed in the developing device, wherein the drive source of the developing means and that of the toner recycling means can be individually controlled, and a mode is provided in which only the drive of the toner recycling means is turned off.

In the second embodiment of the present invention, there is provided a switching means through which the developing means and the toner recycling means are driven by the same drive source, whereby the drive of the toner recycling means can be turned on and off.

Further, in the third embodiment of the present invention, there is provided a mode in which the drive of a new toner supply means and the drive of a toner recycling means are stopped and only the image carrier and the developing means are driven in the case where an initial reference value is set in the toner concentration control means.

The fourth embodiment of the present invention is described as follows. The fourth embodiment is a developing device comprising: a developing means for developing an electrostatic latent image formed on an image carrier surface with two-component developer composed of toner and carrier; a toner recycling means for feeding toner removed from the image carrier surface by a cleaning means so as to recycle the toner; and a toner concentration control means for controlling toner concentration in accordance with the result of a comparison between a reference signal that has been set, and a toner concentration of developer determined when the magnetic permeability of developer is detected by a toner concentration detection sensor disposed in the developing device. The developing device is characterized in that: when the time of routine inspection at which the developer is to be replaced has come after the image formation process of the developing means is repeatedly conducted by a predetermined number of times, there is provided a mode in which the image formation process is not conducted, and the forcible idling operation is conducted for a predetermined period of time by the image carrier, developing means and toner recycling means, the recycled toner in the toner recycle means is recovered into the developing device; and after the forcible idling operation conducted in accordance with the forcible mode has been completed, a reference signal of the toner concentration control means is set.

In the fifth embodiment of the present invention, after the forcible idling operation has been completed, the program returns to the image formation process, and in the case where the forcible idling operation is not carried out when the developer is replaced, a signal expressing that a reference signal of developer can not be set is generated and displayed.

In the sixth embodiment of the present invention, when the time of routine inspection at which the developer is to be replaced has come after the image formation process of the developing means is repeatedly conducted a predetermined number of times, there is provided a mode in which the forcible idling operation is conducted for a predetermined period of time by the image carrier, developing means and toner recycling means when the power source is turned on, the recycled toner in the toner recycle means is recovered into the developing device. After the forcible idling operation has been completed by the mode, a reference signal of the toner concentration control means is set.

In the seventh embodiment of the present invention, when the time of routine inspection at which the developer is to be replaced has come after the image formation process of the developing means is repeatedly conducted a predetermined number of times, there is provided a mode in which in an image formation process waiting condition after the power source has been turned on, the forcible idling operation is conducted by the image carrier, developing means and toner recycling means at predetermined intervals for a predetermined period of time, the recycled toner in the toner recycle means is recovered into the developing device. After the forcible idling operation has been completed by the mode, a reference signal of the toner concentration control means is set.

DETAILED DESCRIPTION OF THE PREFERRED EMBODIMENTS

With reference to the accompanying drawings, the present invention will be explained as follows.

Figure 1:
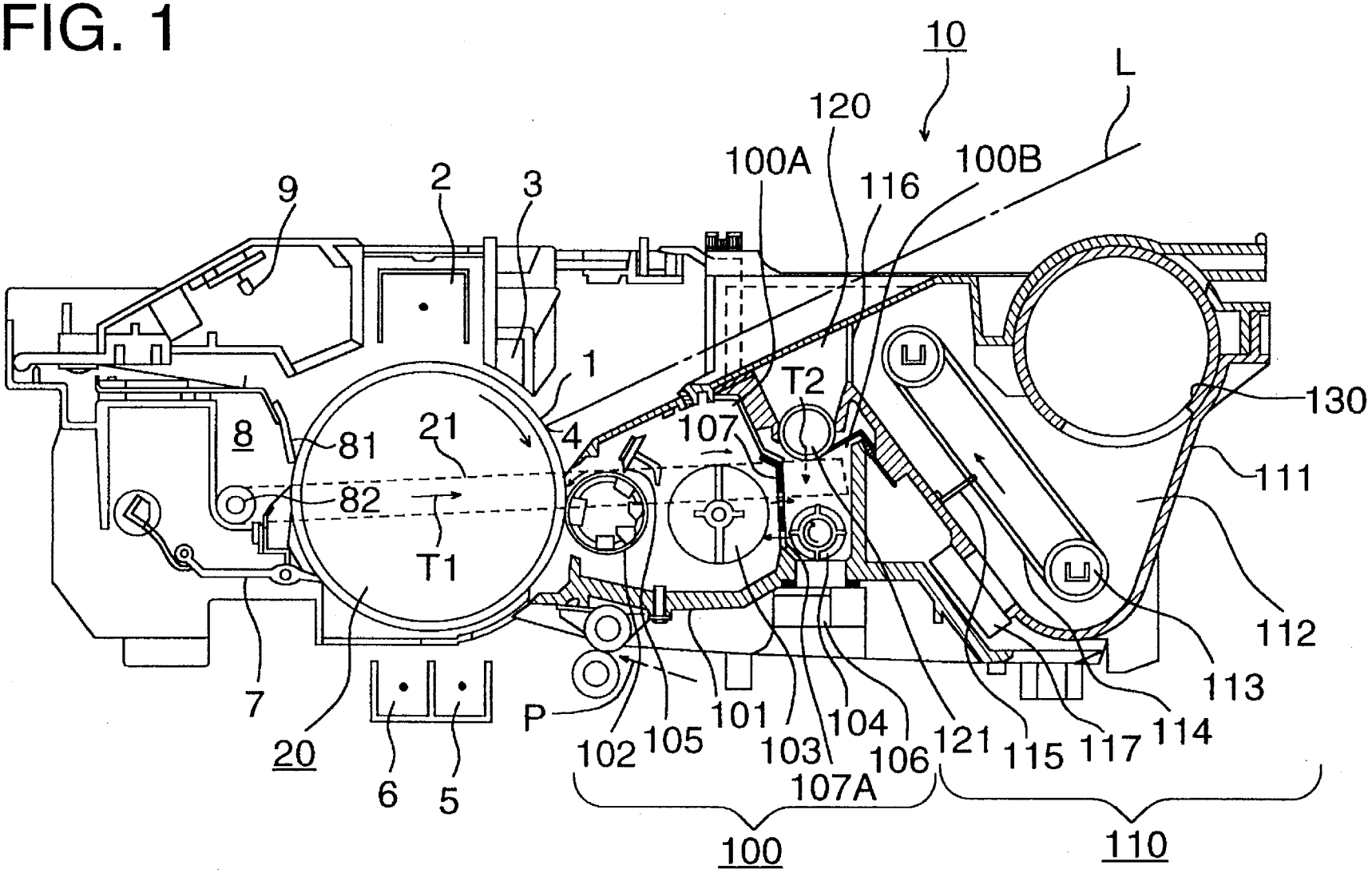
FIG. 1 is a longitudinal sectional view of the image forming unit of the image forming apparatus having the developing device of the present invention.

FIG. 1 is a longitudinal sectional view of the image forming unit of an electrophotographic copier provided with the developing device of the present invention.

The photoreceptor drum (image carrier) 1 is constructed and operated in the following manner:

A photoconductor layer is formed on the outer circumferential surface of a metallic cylinder which is grounded. The photoreceptor drum 1 is rotated in the arrowed direction (clockwise) being linked with the scanning operation of an optical exposure system.

Around the photoreceptor drum 1, the following units are successively provided: a charging electrode 2, erasing LED 3, exposure image forming section 4, developing unit 10, transfer electrode 5, separation electrode 6, separation claw 7, cleaning unit 8, and after-image erasing unit (pre-charge exposure unit) 9.

The image carrier 1 (referred to as a photoreceptor drum hereinafter) having a photoconductor layer for image formation on the outer circumferential surface, is rotated clockwise. First, the surface of the photoreceptor drum 1 is uniformly charged by the charging electrode 2. After that, the circumferential surface is exposed to luminous flux L for image formation sent from the slit exposure optical system, so that an electrostatic latent image is formed on the image formation section 4 on the photoreceptor drum 1. The latent image formed on the photoreceptor drum 1 is developed by the developing device 10 so that the latent image is changed to a visual image.

The transfer and separation electrodes 5 and 6 are disposed below the photoreceptor drum 1, and the developed toner image is transferred by the transfer electrode 5 onto a copy sheet P conveyed from a sheet feed device (not shown). After the copy sheet P has been separated from the photoreceptor drum 1 by the separation electrode 6, it is sent to a fixing device (not shown) disposed on the downstream side so that the toner image is fixed. After that, the copy sheet P is discharged outside from the apparatus.

On the other hand, after the transfer operation has been completed, residual toner T1 on the photoreceptor drum 1 is scraped by a cleaning blade 81 in the cleaning unit 8. Then toner T1 separated from the photoreceptor drum 1 surface drops by its own weight. The dropping toner T1 is received by a screw conveyor 82 disposed under the blade 81 and conveyed to a toner recycling device 20. By the toner recycling device 20, toner T1 is recycled from the cleaning device 8 to the developing device 10. A screw 21 meshed with the screw conveyor 82 rotates. By the action of the screw 21, toner T1 in the cleaning device 8 is conveyed to one end of the auxiliary stirring member 104 of the developing device 10 through a recycled toner conveyance pipe 22.

The developing device 10 mainly includes a developing section 100 and toner replenishment section 110.

Inside a casing 101 of the developing section 100, there are rotatably provided a developing roller 102 composed of a developing sleeve and magnet, primary stirring member 103 having a plurality of stirring blades, and an auxiliary stirring member 104, the configuration of which is a spiral screw. A bristle restricting plate 105 is provided in an upper portion of the developing roller 102, and a toner concentration sensor 106 is provided in a lower portion of the auxiliary stirring member 104.

Inside of a casing 111 of the toner replenishment section 110, there are provided a cartridge accommodation chamber 112 in which a toner cartridge 130 is detachably provided, ladder wheel 113 for conveying upward the toner stored in the bottom portion of the casing 111, ladder chain 114, toner conveyance means composed of a toner scraping member 115, toner residual amount detection sensor 117, and toner replenishing member 121.

When a portion of the photoreceptor drum 1 on which the electrostatic latent image is formed comes to a position (developing region) close to the developing roller 102, toner particles are attracted onto the electrical charge holding portion on the photoreceptor drum 1, so that a toner image is formed.

When the copying operations are repeated, an amount of toner in the developing section 100 is decreased and the toner concentration is lowered. The toner concentration detection sensor 106 detects that the toner concentration has been lowered. Then replenishment toner is conveyed upward by the toner conveyance means in the toner replenishing section 110. When the toner replenishing member 121 is rotated, the conveyed toner drops from an opening of the casing 111. Then the dropped toner is mixed with the developer and conveyed when the auxiliary stirring member 104 of the toner replenishing section 100 is rotated, and further the toner and developer are stirred and mixed by the main stirring member 103, and one portion is supplied onto the developing roller 102, and the other portion is supplied onto the auxiliary stirring member 104.

Figure 2:
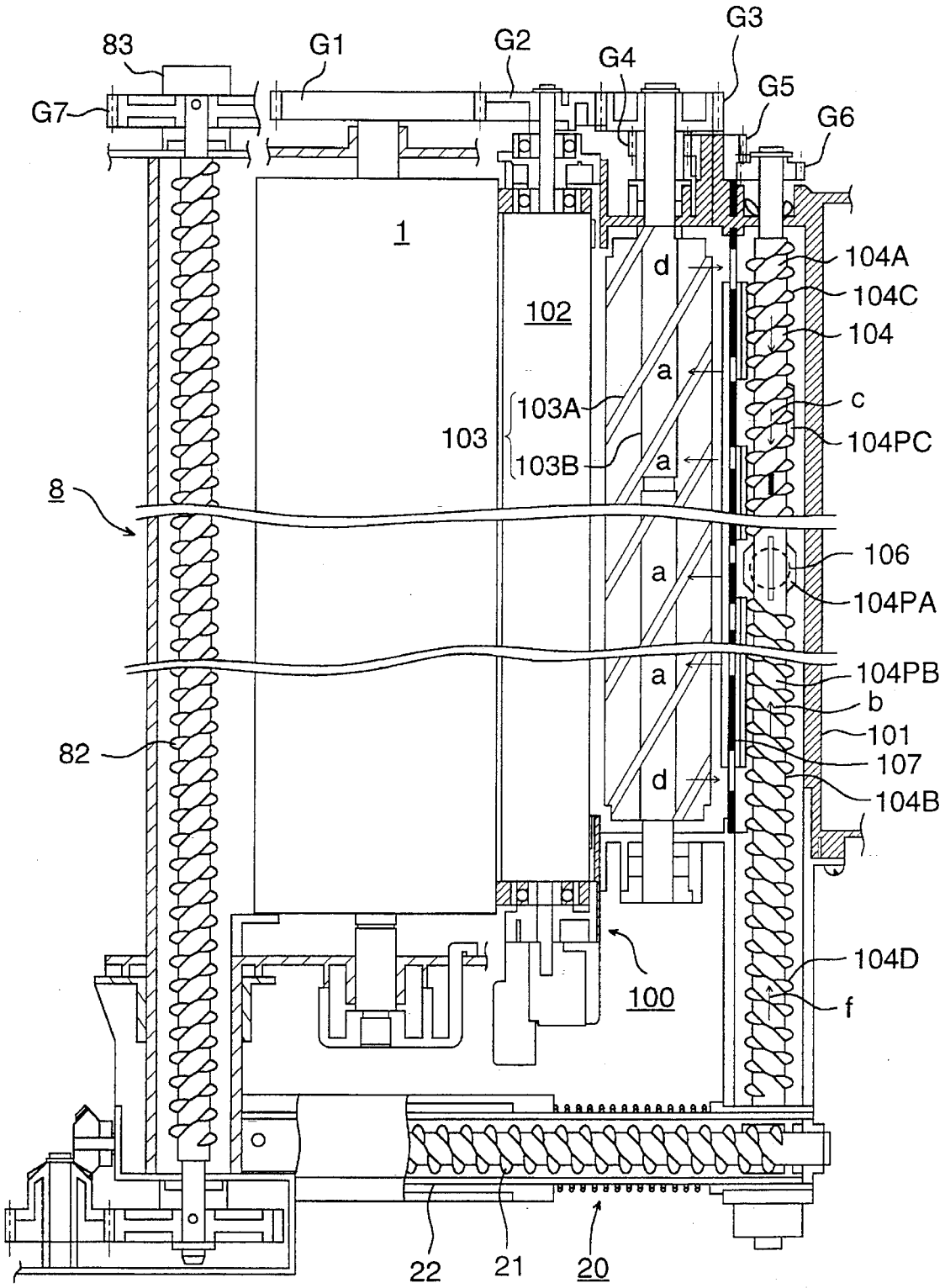
FIG. 2 is a lateral sectional view of the developing device of the present invention.

FIG. 2 is a lateral sectional view of the above image forming section.

The primary stirring member 103 includes a plurality of oval stirring blades 103A fixed to a rotational shaft 103B. Gear G3 fixed to an end of the shaft portion is driven by gear G1 of the photoreceptor drum 1 connected with the drive source, through gear G2 attached to an end of the developing roller 102, wherein gear G3 is rotated in a direction reverse to that of the developing roller 102. Due to the above construction, the primary stirring member 103 mixes and stirs the developer in the developing section 100 so that the developer is supplied onto the developing roller 102.

The auxiliary stirring members 104 includes: a rotational shaft 104A connected with the drive source; spiral screw portions 104B, 104C integrally formed on the outer circumference of the rotational shaft 104A so as to convey the developer; and a plurality of paddle portions 104PA, 104PB, 104PC provided in the spiral screw portion so as to discharge the developer in a rotational direction when the rotational shaft 104A is rotated. The aforesaid spiral screw portion includes a left spiral screw portion 104B to convey the developer in the normal direction, and a right spiral screw portion 104C to convey the developer in the reverse direction. When both the spiral screw portions 104B, 104C are driven, the developer is conveyed to a center of both the spiral screws to which developer is concentrated in the directions b and c shown in the drawing.

A main paddle portion 104PA is integrally provided in the spiral screw portion 104B of the normal direction, the spiral screw portion 104C of the opposite direction, and also provided in the proximity of the center, wherein the main paddle portion 104PA is disposed in a direction perpendicular to the rotational shaft 104A. A subsidiary paddle portion 104PB composed of a plurality of blades perpendicular to the rotational shaft 104A is provided in one spiral screw portion 104B. In the same manner, a subsidiary paddle portion 104PC composed of a plurality of blades is provided in the other spiral screw portion 104C. By the actions of the primary paddle portion 104PA and the auxiliary paddle portions 104PB, 104PC, the conveyed developer is discharged in a direction perpendicular to the rotational shaft (in the direction of a normal line) when the rotational shaft 104A is rotated.

The rotational shaft 104A of the auxiliary stirring member 104 is concurrently rotated by gear G6 in the same direction as that of the primary stirring member 103 through gear G1 to drive the photoreceptor drum 1, gear G2 provided at the end of the shaft of the developing roller 102, gear G3 provided at the end of the shaft of the primary stirring member 103, and intermediate gears G4 and G5. The left spiral screw portion 104B of the auxiliary stirring member 104 is extended to left, so that toner T1 recovered by the cleaning device 8 is conveyed to a reception opening provided at the screw end 104D through the toner recycle device 20.

A toner concentration sensor 106 is provided just under the primary paddle portion 104PA approximately in the center of the auxiliary stirring member 104, that is, the toner concentration sensor 106 is provided in the bottom portion of the casing 101 approximately in the center.

As illustrated in FIG. 1, in an upper portion of the auxiliary stirring member 104, a toner replenishment member 121 is rotated and driven at an appropriate time. Therefore, an appropriate amount of new replenishment toner T2 drops into a toner cartridge 130, so that toner T2 is supplied onto the auxiliary stirring member 104.

A separation plate 107 is interposed between the primary stirring member 103 and the auxiliary stirring member 104, and the separation plate 107 is fixed to the casing 101. By this separation plate 107, the development section 100 is divided into the right and left chambers illustrated in FIG. 1. That is, the right chamber is a toner conveyance chamber 100B including the auxiliary stirring chamber 104, and the left chamber is a development chamber 100A including the primary stirring member 103.

A large opening 107A for the flow of developer is formed approximately in the center of the separation plate 107. The opening 107A is formed in the following manner. Length of the opening 107A corresponds to that of the primary paddle portion 104PA and also corresponds to that of the right and left subsidiary paddle portions 104PB, 104PC. Developer is discharged in the direction of the normal line of the rotational shaft from the primary paddle portion 104PA and the plurality of subsidiary paddle portions PB of the auxiliary stirring member 104. The discharged developer passes through the opening 107A of the separation plate 107, and is discharged in the direction of "a" shown in the drawing. Then the developer is conveyed and stirred by the primary stirring member 103.

In an upper portion of the opening 107A of the separation plate 107, a plurality of openings 107B for the flow of developer, the configuration of which is an ellipse, are formed. The plurality of openings 107B are provided in the upper portion of the plurality of subsidiary paddle portions 104PB, 104PC disposed in the right and left spiral screw portions 104B, 104C of the auxiliary stirring member 104. Accordingly, the toner returned from the primary stirring member 103 passes through the plurality of opening 107B of the separation plate 107, and flows into the subsidiary paddle portions 104PB, 104PC in the downstream of the openings of the right and left spiral screws 104B, 104C of the auxiliary stirring member 104.

A toner replenishment chamber 120 is provided in an upper space of the toner replenishment member 121. Toner T2 stored in a cartridge accommodation chamber 112 is supplied to the toner replenishment chamber 120 in the following manner:

By the action of a drive roller 113 and ladder chain 114, toner T2 is scooped by a toner scooping member 115. Then the scooped toner passes through an opening 116 in an upper portion of the boundary wall between the cartridge accommodation chamber 112 and the toner replenishment chamber 120, so that the toner T2 can be supplied to the toner replenishment chamber 120.

Figure 3:
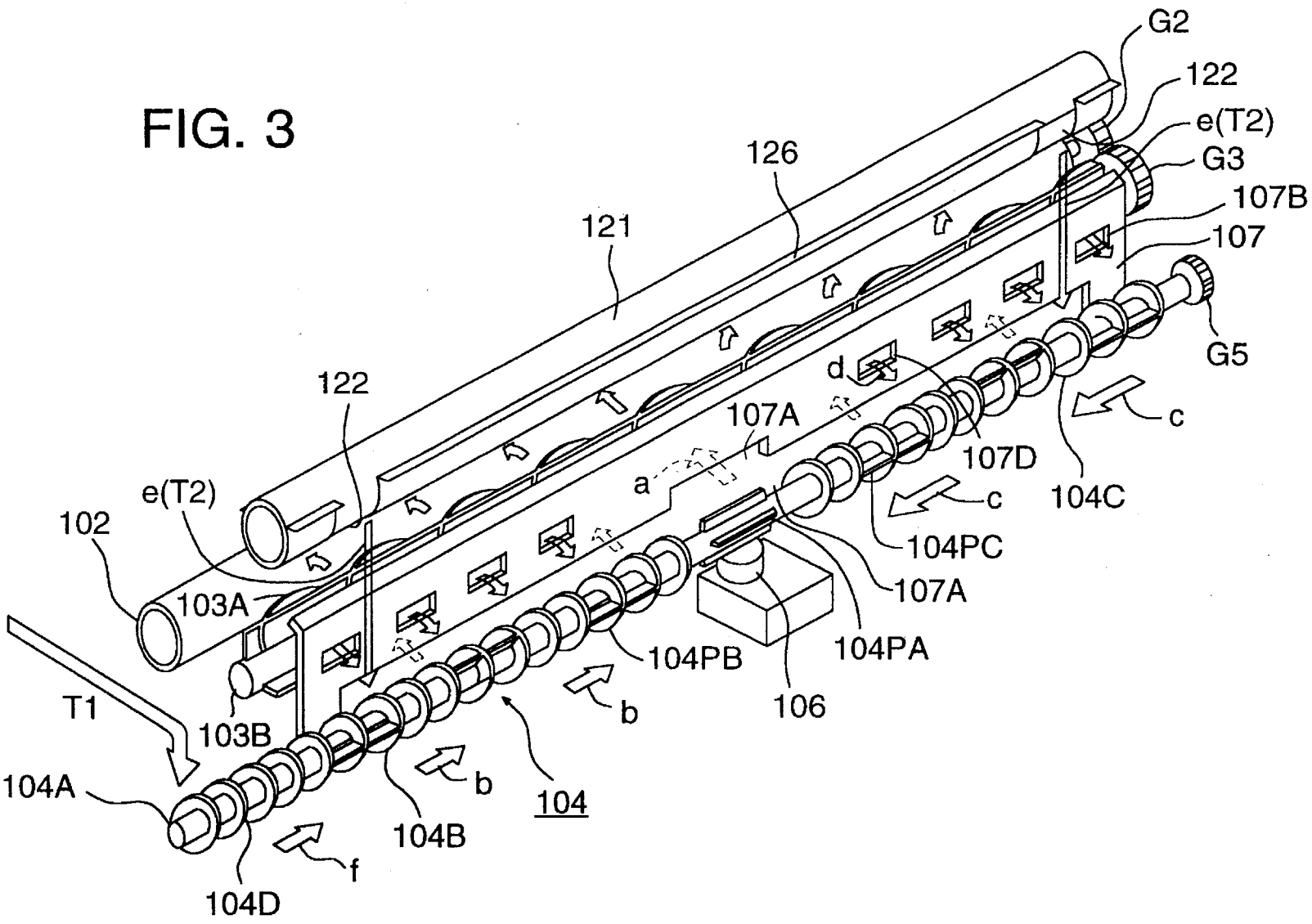
FIG. 3 is a perspective view for explaining the circumstances of circulation of developer in the developing device of the present invention.

FIG. 3 is a perspective view for explaining the recirculation of developer of the developing device of the present invention.

Two openings 122 are formed in the lower ends of the toner replenishment chamber 120. These openings 122 are closed by the toner replenishment member 121 disposed upward.

The openings 122 are disposed in the downstream of toner conveyance of the primary paddle portion 104PA and the subsidiary paddle portions 104PB, 104PC, that is, the openings 122 are disposed in positions corresponding to both shaft ends of the auxiliary stirring member 104. All portions except for the openings 122 are closed by a shielding member 126. The shielding member 126 is made of a polyethylene terephthalate film, and adhered to an opening of the casing 111.

The toner replenishment member 121 is driven in the arrowed direction by a detection signal of the toner concentration detection sensor 106. Then toner T2 in the toner replenishment chamber 120 is involved in the spiral grooves of the toner replenishment member 121, and drops from the opening 122, so that toner T2 is supplied onto the auxiliary stirring member 104.

That is, when the toner replenishment member 121 is rotated, the new replenishment toner T2 in the toner replenishment chamber 120 drops from the opening 122 which is not closed by the shielding member 126, and is scattered on the auxiliary stirring member 104 and the spiral screw portions 104B, 104C located on the upstream side. Further, when the screw portions 104B, 104C are rotated, toner T2 is conveyed in the directions b and c, and mixed with the returned developer. Then, a portion of developer is discharged by the subsidiary paddles 104PB, 104PC on the downstream side in the direction (a) of the normal line of the rotational shaft, and another portion of developer is further conveyed onto the downstream side, and is discharged in the direction (a) of the normal line of the rotational shaft by the primary paddle portion 104PA disposed in the center.

On the other hand, the new replenishment toner T2 and recycled toner T1 are joined at the left spiral screw portion 104B located on the left of the auxiliary stirring member 104, and the joined toner is conveyed in the directions of f and b. In the same manner, both toner T1 and toner T2 are discharged in the direction "a" by the primary paddle portion 104PA and the subsidiary paddle portion 104PB.

In these drawings, arrows represent the directions in which the developer is moved.

New toner T2 is supplied to the toner conveyance chamber 100B on the right of the development section 100 from the toner replenishment member 121 in the direction of arrow e. In this way, new toner T2 is supplied to the positions close to both shaft ends. The supplied toner is conveyed in the directions b and c by the right and left spiral screw portions 104B, 104C which can convey the supplied toner in the opposite direction. In this way, the supplied toner is collected to the center. Also, the recycled toner T1 supplied to the screw end portion 104D of the auxiliary stirring member 104 is joined on the spiral screw portion 104B, and mixed with the recycled developer described later. However, the subsidiary paddle portions 104PB, 104PC are provided on the upstream side of the auxiliary stirring member 104, and further the shielding wall portions 107C, 107C are provided on both ends of the separation plate 107. Accordingly, the recirculated developer, new replenishment toner T2 and recycled toner T1 are sufficiently mixed and stirred by the spiral screw portions 104B, 104C without being discharged outside. After the toner has been made uniform in this way, it is conveyed to the center on the downstream side.

The above mixed developer is further conveyed to the center by the right and left spiral screw portions 104B, 104C. Then the mixed developer is radially discharged by the subsidiary paddle portions 104PB, 104PC on the downstream side. Then the developer passes through the opening portion 107A for the flow of developer located under the separation plate 107, and is supplied to the primary stirring member 103 in the direction "a". Further, a portion of the mixed developer is conveyed to the center by the spiral screws 104B, 104C, and radially scattered by the primary paddle portion PA. After that, the developer is sent to the development chamber 100A located on the left of the development section 100 from the opening portion 107A for the flow of developer of the separation plate 107 in the direction "a".

When the developer passes through the opening portion 107A for the flow of developer of the separation plate 107 from the primary paddle portion 104A and the subsidiary paddle portions 104PB, 104PC, the toner concentration sensor 106 disposed under the primary paddle portion 104PA detects the toner concentration of the developer.

After the developer has passed through the opening portion 107A, it is mixed and stirred with the developer recirculated from the development region by the stirring blades 103A of the rotational primary stirring member 103. After the developer has been made uniform in the above manner, it is supplied to the developing roller 102, and the thickness of the developer layer is regulated by the bristle regulation plate 105. After that, the developer is conveyed to the developing region.

While the developer is stirred by the primary stirring member 103, the developer sent in the direction d passes through a plurality of openings 107D for the flow of developer formed in the separation plate 107. Then the developer is recirculated to the spiral screw portions 104B, 104C of the auxiliary stirring member 104.

The recirculated developer, replenishment toner and recycled toner pass through the openings 107D of the separation plate 107. After that, the toner is conveyed to the center in the directions of b and c by the right and left spiral screw portions 104B, 104C of the auxiliary stirring member 104. During the conveyance, a portion of the developer is radially discharged in a direction the normal line of the rotational shaft by the action of the subsidiary paddle portions 104PB, 104PC in the downstream. Then the developer passes through the opening portion 107A of the separation plate 107, and flows to the primary stirring member 103. The residual developer and replenishment toner are conveyed to the center by both spiral screw portions 104B, 104C. Then the developer is radially discharged by the main paddle portion 104PA and circulated in the direction of arrow "a".

Due to the developer circulation path described above, the new toner, recycled toner and the developer stored in the development section 100 are uniformly mixed. Even when the concentration of toner in the development section 100 has become uneven in the repeated copying process, the developer can be conveyed and stirred in the direction of the rotational shaft while it is being conveyed in the above circulation path. As a result of the foregoing, the occurrence of unevenness of copied images can be avoided.

Figure 4:
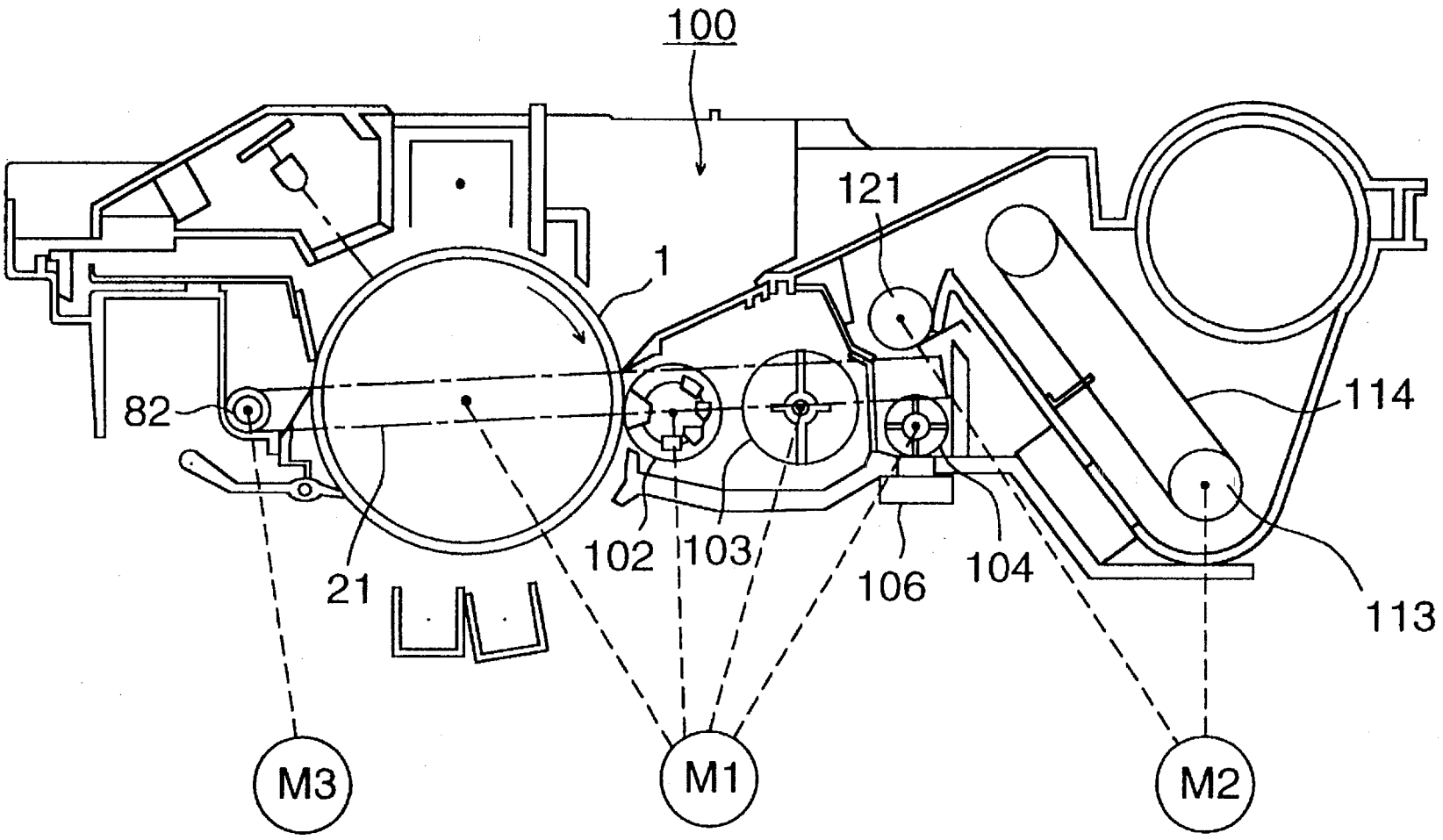
FIG. 4 is a drive system diagram of the first example of the developing device of the present invention.
Figure 5:
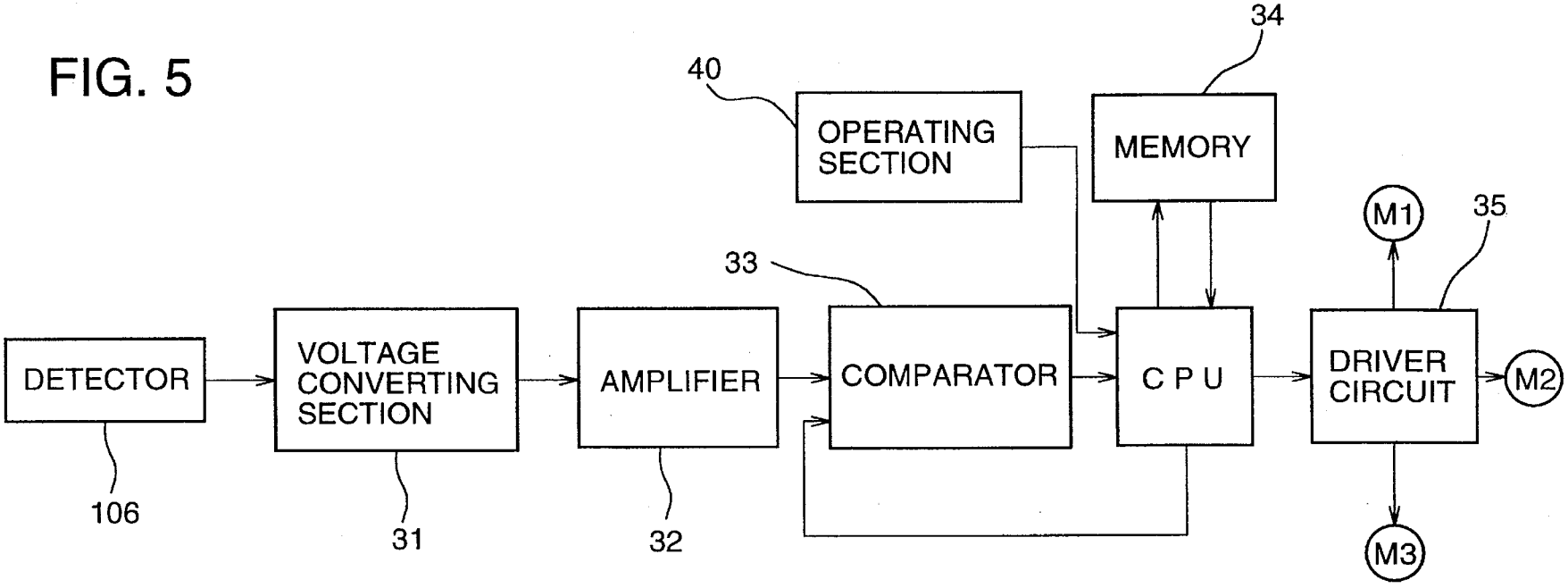
FIG. 5 is a block diagram of the toner concentration control device of the above developing device.
Figure 6:
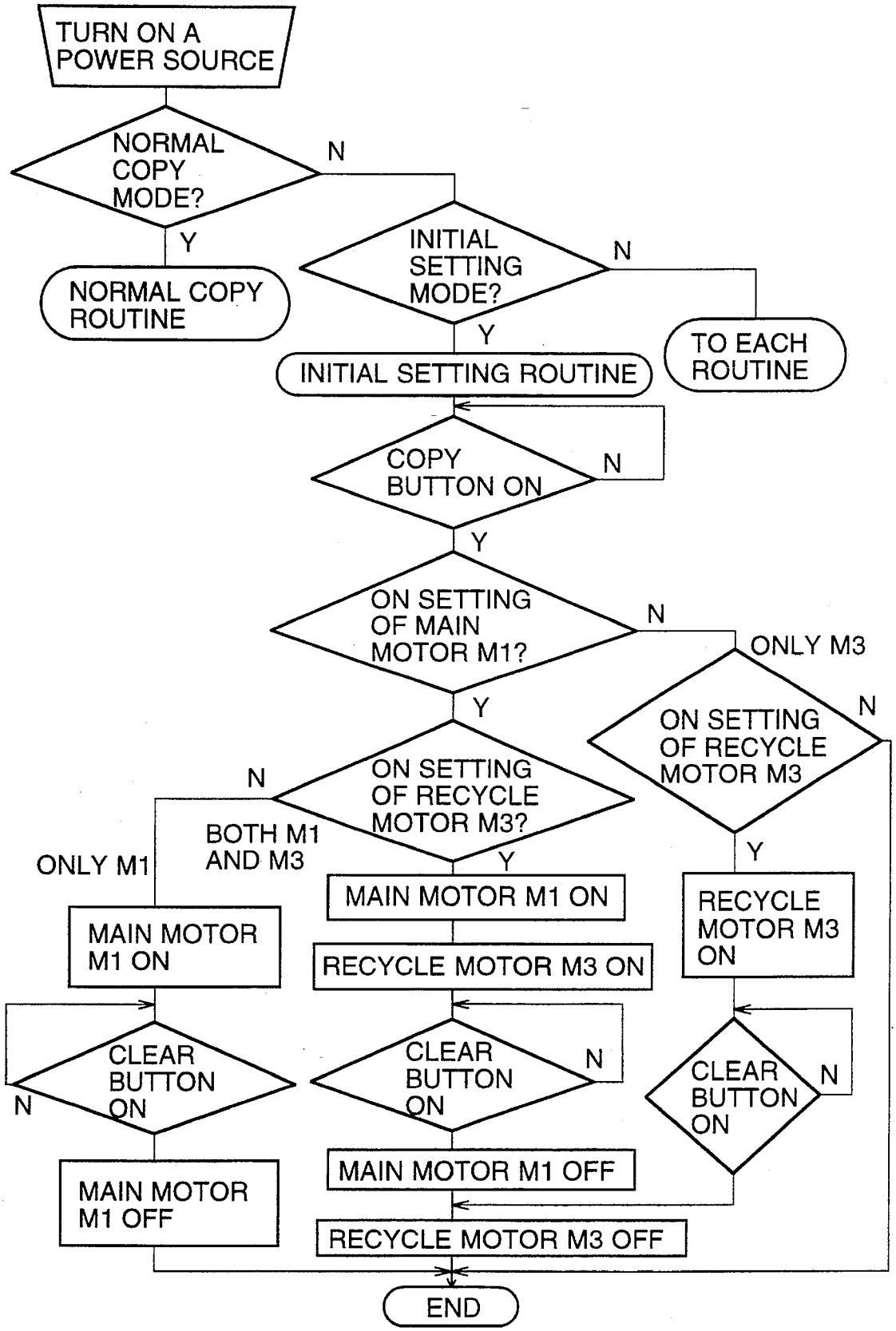
FIG. 6 is a flow chart of the initial reference value setting of the toner concentration control device.

FIG. 4 is a drive system diagram of the first example of the development device of the present invention. FIG. 5 is a block diagram of the toner concentration sensor control unit of the development device illustrated in FIG. 5. FIG. 6 is a flow chart of initial setting of the toner concentration control unit.

As illustrated in FIG. 4, the main motor M1 drives the photoreceptor drum 1, developing roller 102, primary stirring member 103, and auxiliary stirring member 104. The sub-motor (A) M2 drives the drive roller 113 to drive the ladder chain 114, and the toner replenishment member 121. The sub-motor (B) M3 drives the screw conveyor 82 and screw 21 for conveying the recycled toner.

As illustrated in FIG. 5, an output signal of the toner concentration detection sensor 106 is converted into a voltage in accordance with the toner concentration by the voltage conversion section 31. Then the output signal is amplified by the amplifier 32 and compared with a reference signal through the memory 34 and CPU. The obtained result is stored in the memory section (for example, a non-volatile memory) 34. The result of the comparison is sent to the driver circuit 35 through the CPU so as to control the motors M1, M2 and M3.

Next, according to the flow chart shown in FIG. 6, a service man replaces the developer in the developing device in use, and explains the initial setting operation.

(1) A power switch of the copier is turned on.

(2) In a normal copy routine, all motors M1, M2 and M3 are turned on, and the image formation process is carried out.

(3) When a predetermined ten-keys for setting the number of copy sheets (for example, ten-keys 4 and 7) disposed in the operation section (operation panel) 40, is pressed and the power switch is also pressed concurrently, the routine of initial setting can be set. In this connection, the aforementioned setting operation in which ten-keys are used can be also applied for setting the routines except when the reference value setting mode is determined.

(4) Next, when predetermined ten-keys (for example, ten-keys 5 and 1) are pressed and also the copy button is pressed concurrently, the first mode can be set. In this case, the main motor M1 and the sub-motor (B) M3 for toner recycling are driven. Also, when predetermined ten-keys (for example, ten-keys 5 and 2) are pressed and also the copy button is pressed concurrently, the second mode can be set. In this case, only the main motor M1 is driven. Further, when other ten-keys (for example, ten-keys 5 and 3) are pressed and also the copy button is pressed concurrently, the third mode can be set. In this case, the main motor M1 is turned off, and only the sub-motor (B) M3 can be driven. When the second mode is set, only the main motor M1 is driven, and the photoreceptor drum 1 and the development section 100 are is activated, and then the developer in the casing 101 of the development section 100 is stirred and circulated. Consequently, the recycled toner T1 is not returned. In the aforementioned initial setting modes, the sub-motor (A) M2 of the toner replenishment section 110 is turned off, so that new toner is not supplied.

(5) After these operations have been continued for a predetermined period of time (for example, for 3 minutes), a clear button on the operation panel is pressed. Then the output voltage of the toner concentration detection sensor 106 can be maintained constant.

Figure 7:
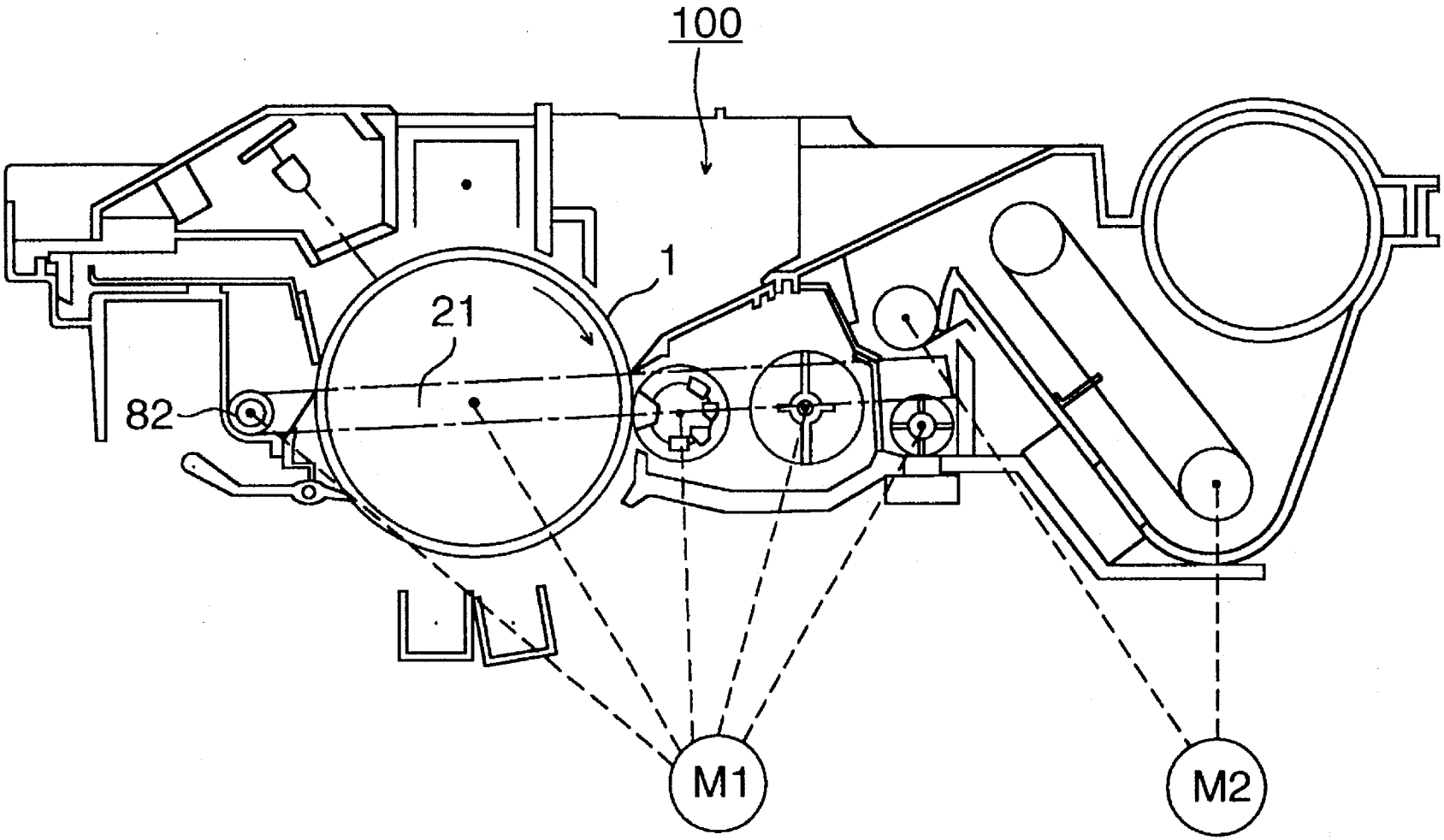
FIG. 7 is a drive system diagram showing the second and fourth examples of toner control of the developing device of the present invention.
Figure 8:
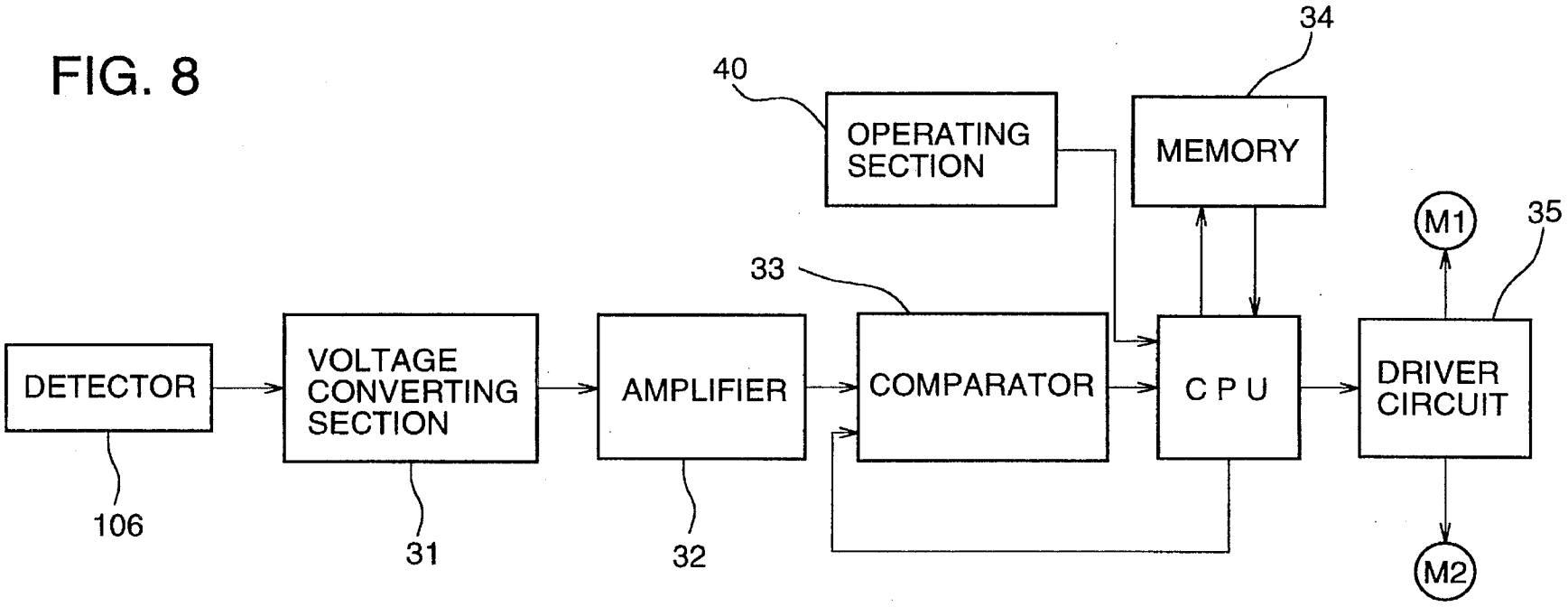
FIG. 8 is a block diagram of the above toner concentration control device.

FIG. 7 is a drive system diagram showing the second and fourth examples of toner control of the developing device of the present invention, and FIG. 8 is a block diagram of the above toner concentration control device.

In this example, the main motor M1 drives the photoreceptor drum 1, and the screw conveyor 82 and screw 21 of the development section 100 and cleaning section 8. Gear G1 mounted on the shaft of the photoreceptor drum 1 is connected with the drive source of the copier. Gear G1 is connected with gear G7 mounted on an end of the shaft of the screw conveyor 82 through a drive transmission switching means 83 such as an electromagnetic clutch (shown in FIG. 2).

When the electromagnetic clutch 83 described above is switched, the torque transmitted from the main motor M1 to the screw conveyor 82 and screw 21 for toner recycle can be turned on and off. Due to the foregoing, the toner recycling operation is interrupted, and only the photoreceptor drum 1 and development section 100 can be driven by a single drive source. When the developer is stirred for a predetermined period of time under the condition that the toner recycling operation is stopped and the photoreceptor drum 1 and development section 100 are driven in the aforementioned manner, the toner concentration is not changed after the predetermined period of time has passed, so that a predetermined reference concentration of toner can be maintained. Accordingly, the initial reference value can be accurately set to the toner concentration detecting sensor.

Figure 9:
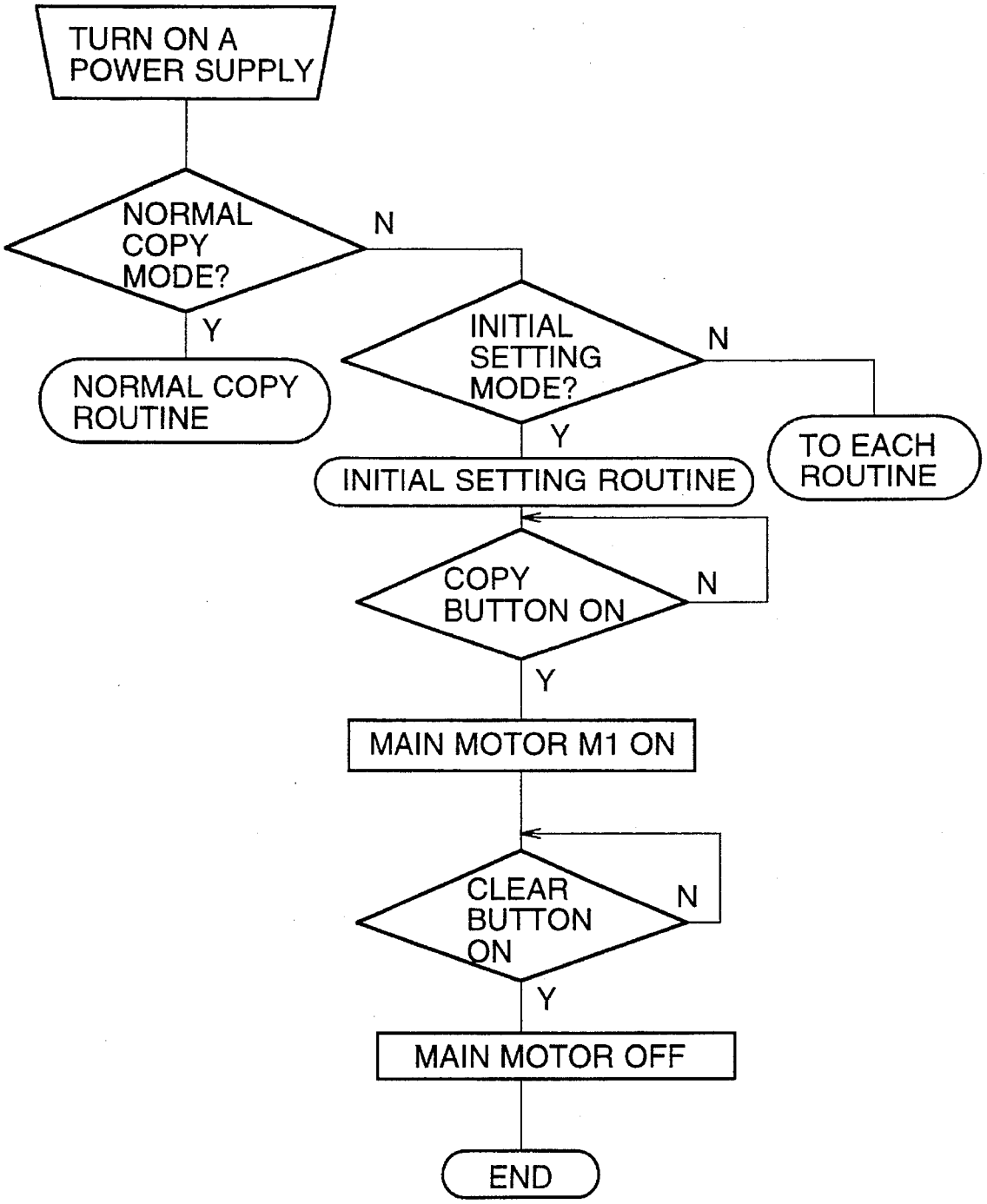
FIG. 9 is a flow chart of initial reference value setting of the third example of toner concentration control of the present invention.
Figure 10:
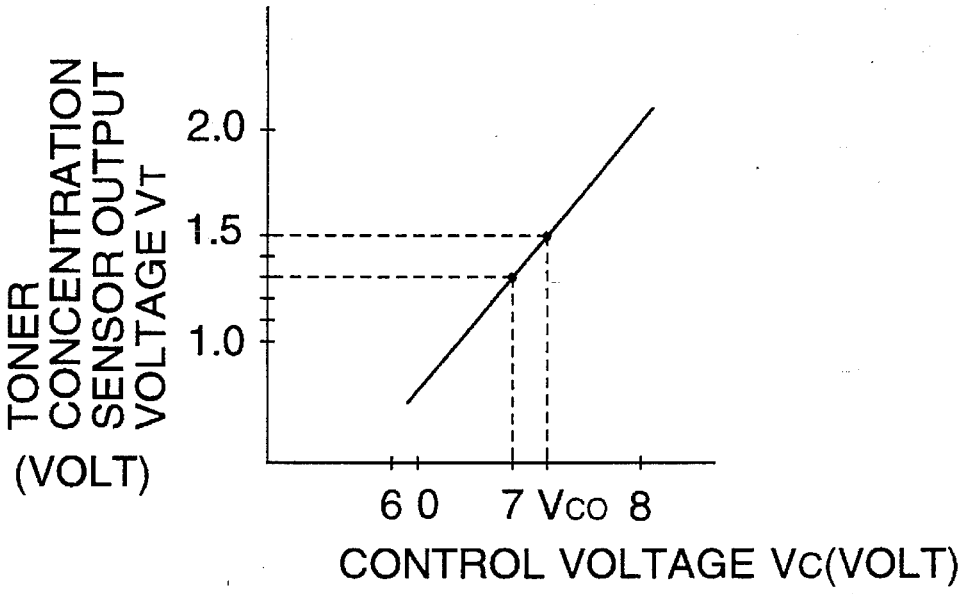
FIGS. 10(A) and 10(B) are characteristic diagrams of the toner concentration sensor.
Figure 10:
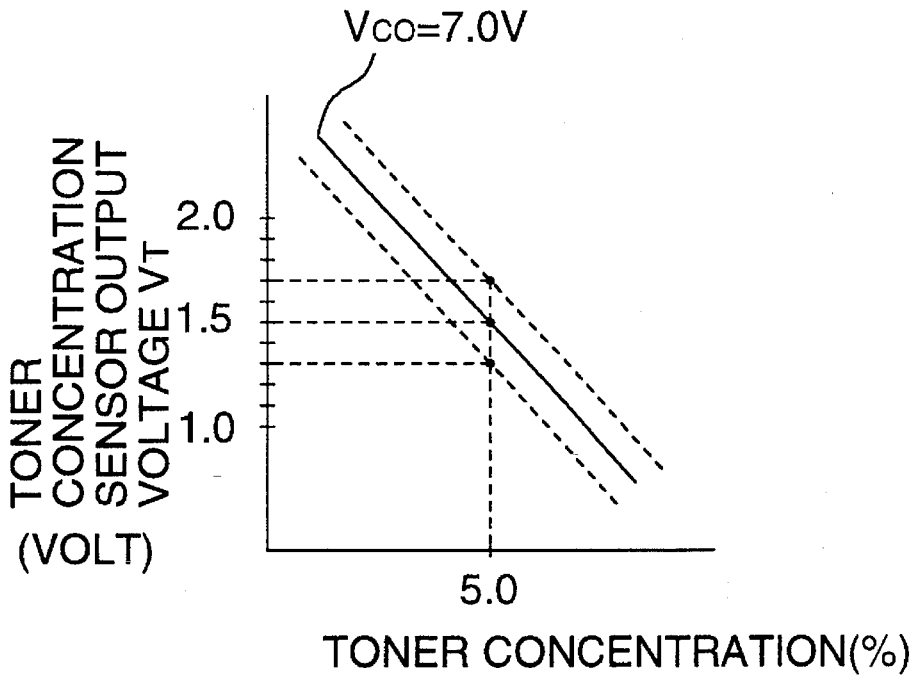

FIG. 9 is a block diagram of the third example of toner concentration control of the present invention.

Since the drive system of this example is the same as that shown in FIG. 4, the explanation of the drive system of this example will be omitted here.

In the same manner as that of the first and second examples, the following operations are performed:

(1) The power source is turned on.

(2) The initial setting mode is set when the ten-keys are operated.

(3) Under the above setting condition, the copy button is turned on.

Then, only the main motor M1 is driven, and the sub-motor M2 of the toner replenishment section 110 and the sub-motor M3 of the toner recycling means are stopped, so that only the photoreceptor drum 1 and development section 100 are driven. Consequently, the developer in the development chamber 100A of the development section 100 is stirred and sent to the development region so as to be recirculated to the development chamber 100A. After the developer has been stirred and circulated for a predetermined period of time (for example, 3 minutes), the output voltage of the toner concentration sensor 106 is maintained constant, so that the initial reference value can be set.

In this connection, the drive transmission switching means 83 illustrated in FIG. 2 may be provided in this example, and the toner recycling means may be stopped while the main motor M1 is driven.

Since the developing device of the present invention is constructed in the manner described above, the toner concentration control based on the initial setting of the toner concentration detecting sensor can be precisely, easily conducted without being affected by recycle toner.

Figure 11:
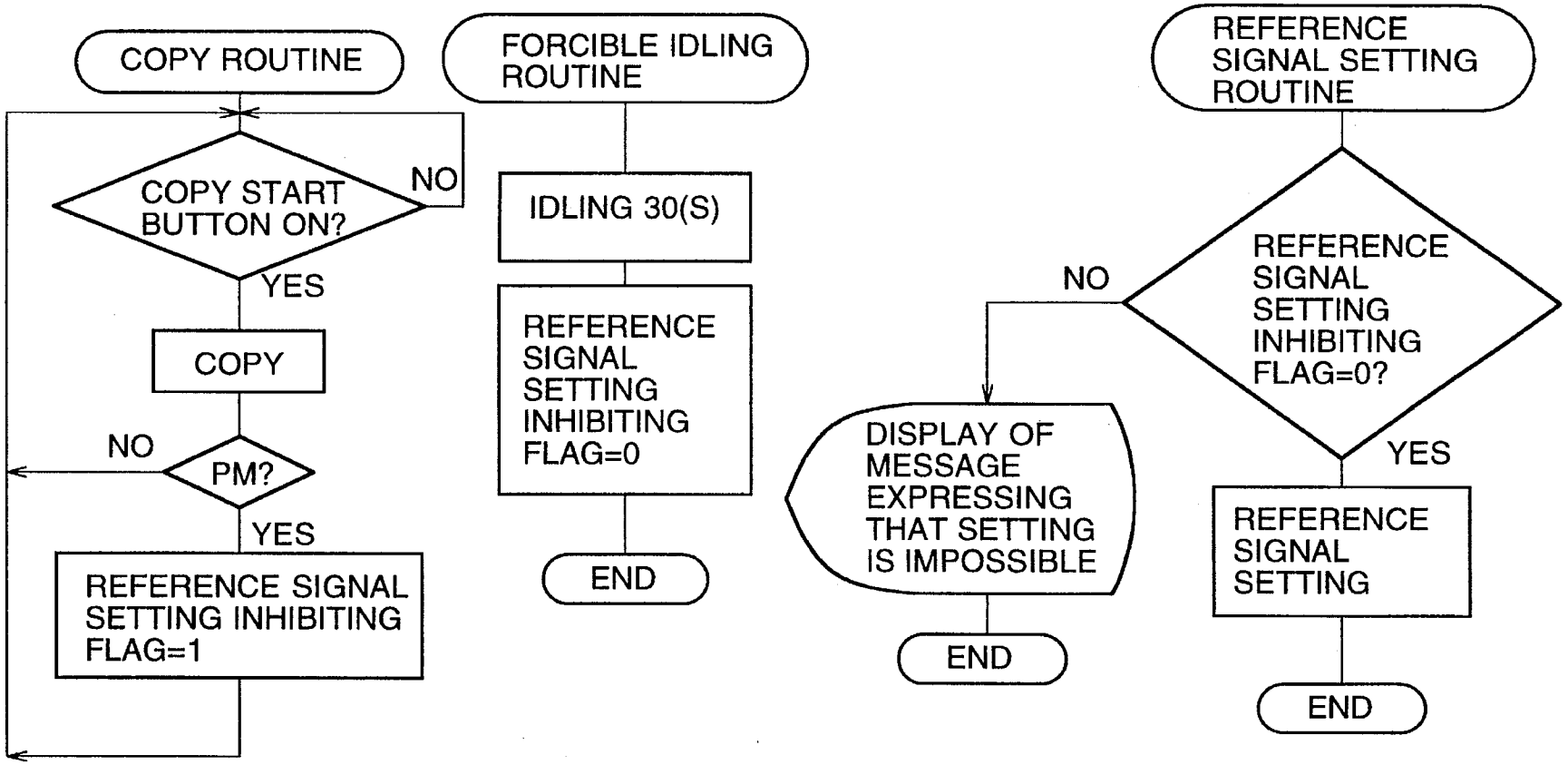
FIGS. 11(A) to 11(C) are flow charts of initial reference value setting of the fourth example of toner concentration control of the present invention.

FIG. 7 is a drive system diagram showing the second and fourth examples of toner control of the developing device of the present invention. FIG. 8 is a block diagram of the above toner concentration control device. FIG. 11 is a flow chart of initial reference value setting of the fourth example of toner concentration control of the present invention, wherein the reference signal setting is conducted before the developer is replaced in the routine inspection.

In FIG. 7, the main motor M1 drives the photoreceptor drum 1, developing roller 102 of the development section 100, primary stirring member 103, auxiliary stirring member 104, and screw conveyor 82 and screw 21 for conveying recycled toner. The sub-motor M2 drives the drive roller 113 for driving the ladder chain 114, and the toner replenishment member 121.

As illustrated in FIG. 8, the output signal of the toner concentration detecting sensor 106 is converted by the voltage conversion section 31 into a voltage in accordance with the toner concentration. Then the voltage is amplified by the amplifier 32, and compared by the comparator 33 with a reference signal sent from the memory 34 through the CPU. After the comparison, the compared value is stored in the memory (for example, a non-volatile memory) 34. This compared value is sent to the driver circuit 35 through the CPU so as to control the motors M1 and M2.

Next, with reference to the flow charts shown in FIGS. 11(A)–11(C), the fourth example of the toner concentration control process of the present invention will be explained as follows.

(1) A normal copy routine is repeated in the copier by an operator. In this normal copy routine, the motors M1 and M2 are turned on, so that the image formation process is carried out.

(2) After the above image formation process has been repeated for a predetermined period of time, the device comes to the time of routine inspection in which the developer must be replaced. For example, after the copier has copied 15000 copy sheets, the developer is replaced. In this case, the toner concentration control means including the toner concentration detecting sensor 106 raises a reference signal setting inhibiting flag.

(3) In this connection, the time of routine inspection in which the developer is replaced, is displayed on the operating section 40 of the copier when a predetermined number has been counted by the copy counter.

(4) Next, when predetermined ten-keys (keys for setting the number of copy sheets) provided on the operating section (operation panel) 40 are pressed and the copy button is concurrently pressed, the apparatus is set to the forcible idling routine. In this routine, neither image formation nor toner replenishment is conducted. In this routine, when the main motor M1 is rotated, the photoreceptor drum 1, development section 100 and toner recycle device 20 are driven, so that the developer in the development section 100 is stirred and circulated, and at the same time, the recovered toner (recycled toner) T1 in the cleaning device 8 is returned to the development section 100 when the screw conveyor 82 is driven by the screw 21. When the above forcible idling operation is carried out for a predetermined period of time (for example, 30 seconds), almost all recovered toner T1 in the cleaning device 8 and toner recycle device 20 can be returned to and accommodated by the development section 100.

(5) Experimental results of the forcible idling routine are shown as follows.

Figure 12:
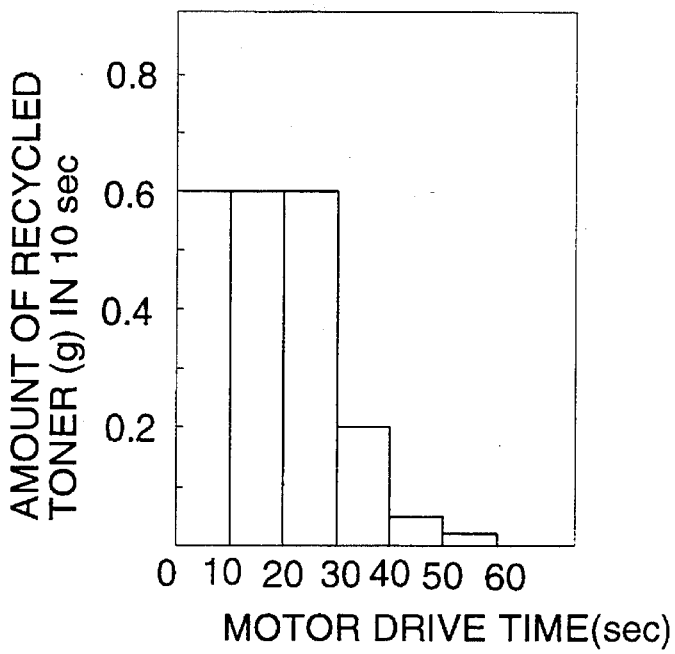
FIGS 12(A) and 12(B) are characteristic diagrams showing the result of recovering recycle toner.
Figure 12:
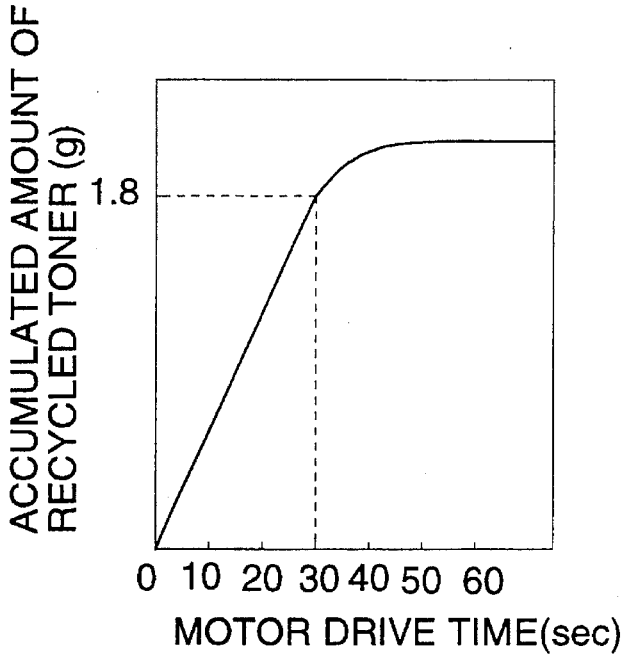

FIGS. 12(A) and 12(B) are characteristic diagrams showing the experimental results of the process of toner recovering. FIGS. 12(A) is a characteristic diagram showing the weight (gram) of recovery toner T1 measured each 10 seconds in the forcible idling operation. FIG. 12(B) is a graph showing the accumulated weight of the recovery toner T1. In this case, the experimental method is described as follows:

An outlet opening of the recycled toner conveyance pipe 22 was separated from the development section 100, so that the recycled toner was dropped into a recovery box held by a scale. In the aforementioned forcible idling routine, the weight of the recovery toner T1 was measured each 10 seconds.

According to the measurement results shown in FIGS. 12(A) and 12(B), the recovery toner T1 of 1.8 grams was returned from the cleaning device 8 and toner recycle device 20 in 30 seconds. In the case of a standard two-component developer of 350 grams and 5.0 weight %, the toner concentration was increased by 0.5% when the recycled toner of 1.8 grams was returned to the development section 100. When the forcible idling routine was conducted for about 30 seconds by the drive of the main motor M1, almost all accumulated amount of the recycled toner T1 shown in FIG. 12(B) was substantially recovered. In this connection, the reason why the forcible idling time was set at 30 seconds is described as follows: The period of time of 30 seconds is the necessary minimum value by which the copy operations are not disturbed. Therefore, it is possible to set at not less than 30 seconds, for example, 60 seconds.

(6) As can be seen from the above measurement results, when the forcible idling routine was carried out for about 30 seconds, almost all recycled toner T1 was returned to the development section 100, and it did not remain in the cleaning device 8 and the toner recycle device 20.

(7) After the forcible idling routine has continued for 30 seconds, the forcible idling operation is stopped, and the reference signal setting inhibiting flag becomes zero. Therefore, a reference signal of the toner concentration control device is set, and the copy operation can be continued.

(8) In this case, a message is displayed on the operating section 40 expressing that the reference signal can not be set unless the reference signal setting flag becomes zero in the forcible idling routine.

(9) In the case of routine inspection in which the developer is replaced, the used developer is replaced with the new one, and the normal toner concentration initial reference value can be set in the following manner:

While the forcible idling routine is conducted, the above inhibiting flag is made to be zero. Then the recycled toner T1 is recovered to the development section 100 or others such as an accommodation box, so that almost all the recycle toner in the cleaning device 8 and recycle device 20 is discharged so that the new developer can be loaded.

Figure 13:
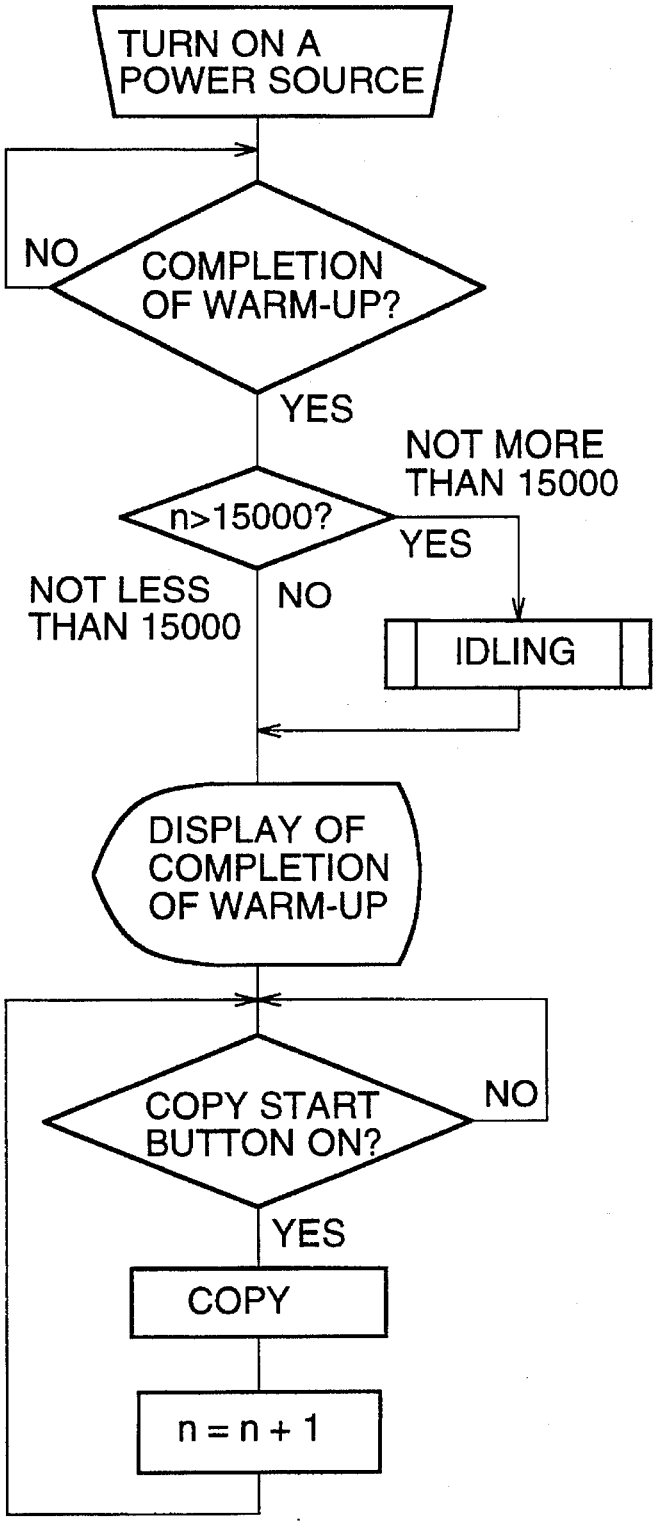
FIGS. 13(A) and 13(B) are flow charts showing the fifth example of toner control of the developing device of the present invention.
Figure 13:
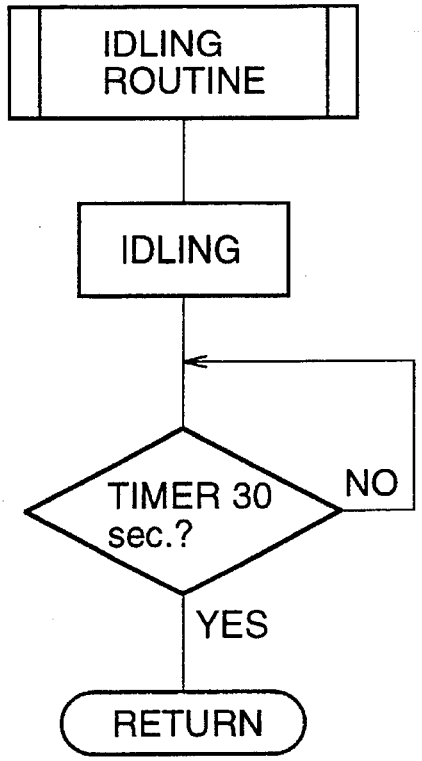

FIGS. 13(A) and 13(B) are flow charts showing the fifth example of toner control of the developing device of the present invention.

The power source is turned on. After the warm-up has been completed, the copy operation is carried out. When it is detected by the copy counter and the control means that the number of copy sheets has reached a predetermined value (for example, 15000 sheets) so that it is necessary to make a routine inspection, the forcible idling operation is started. After the idling operation of the routine has continued for 30 seconds, the operating section 40 displays a message expressing that the warm-up operation has been completed. After that, when the copy start button is pressed, the normal copy operation can be performed. Accordingly, when the idling operation is performed for a predetermined period of time after 15000 copies have been made so as to reduce an amount of toner in the cleaning device 8 and toner recycle device 20, a normal reference signal can be set.

Figure 14:
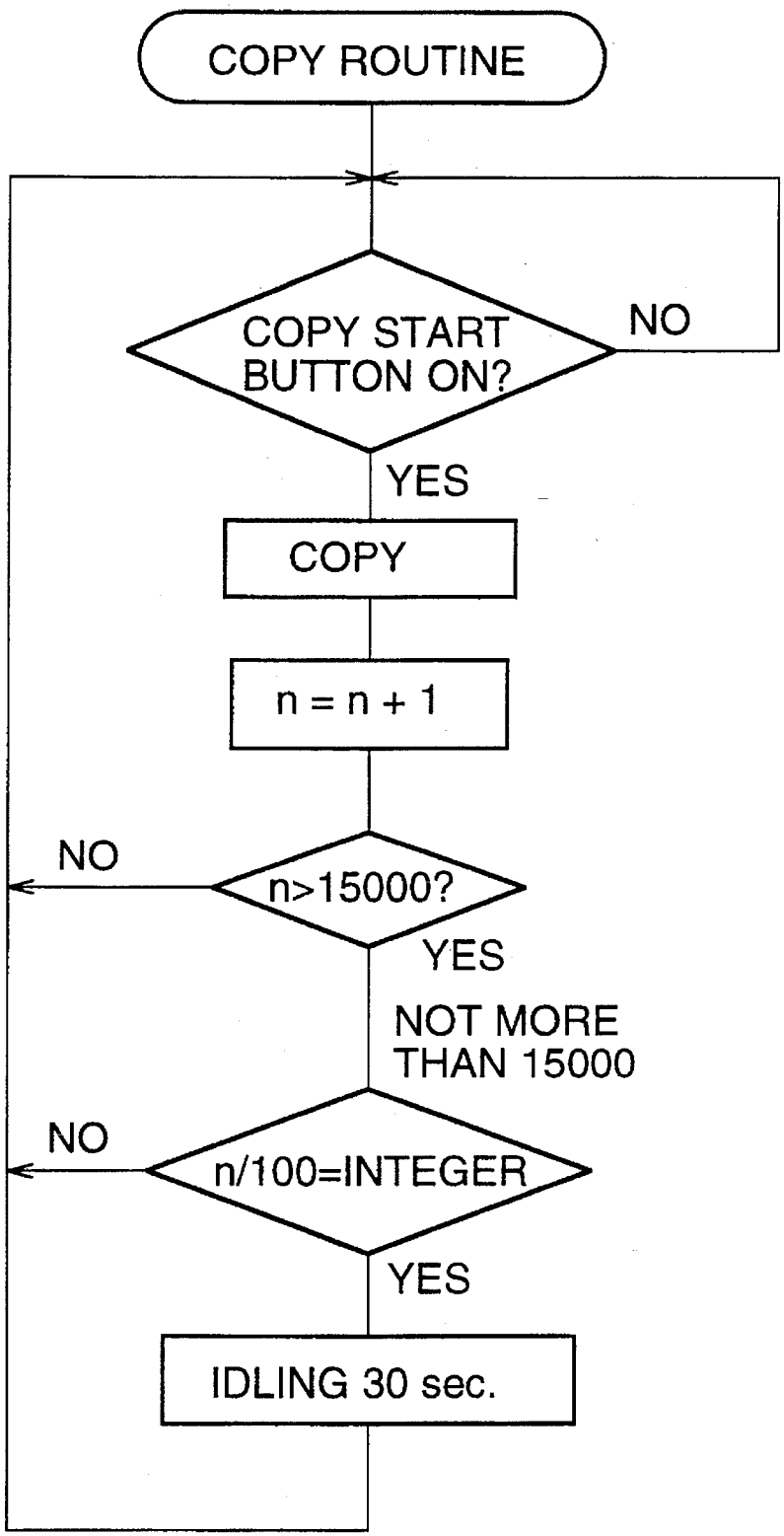
FIG. 14 is a flow chart showing the sixth example of toner concentration control of the present invention.

FIG. 14 is a flow chart showing the sixth example of toner concentration control of the present invention.

In this example, the copy operation is carried out in the following manner:

After the above image formation process has been repeated for a predetermined period of time, the device comes to the time of routine inspection in which the developer must be replaced. For example, after the copier has copied 15000 copy sheets, under the copy ready condition, the image formation process is interrupted at predetermined intervals (for example, each 100 copies), and only the main motor M1 is driven so that the photoreceptor drum 1, development section 100 and toner recycle device 20 are driven for forcible idling operation. When the forcible idling routine is continued for a predetermined period of time (for example, for 30 seconds), almost all recycled toner T1 can be returned to the development section 100. When the reference signal of toner concentration control is set after the completion of the idling routine, the normal setting can be made.

In this connection, when the routine inspection indicating lamp was turned on (for example, when not less than 15000 copies were made), the idling operation was continued for 30 seconds. After that, the idling operation was conducted each 50 copies, and immediately before the idling operation of the 17000-th copy was made, the accumulation amount of recycled toner T1 was measured with the measurement device described before. As a result of the measurement, the accumulated amount of recycled toner T1 was 0.3 gram.

In the case where the recycled toner T1 is returned to the development section when the toner concentration detecting sensor 106 reference signal is set, the toner concentration of developer is increased only by 0.1%. Consequently, when the aforementioned idling routine is carried out, the normal reference signal can be set by the replacement of developer in the developing section 100 in the case where a routine inspection is made.

What is claimed is:

1. An image recording apparatus comprising:

(a) an image carrier for forming an electrostatic latent image thereon;

(b) developing means for developing the latent image with two-component developer composed of toner and carrier;

(c) cleaning means for removing residual toner from said image carrier;

(d) toner recycling means for feeding the toner removed by the cleaning means back to said developing means to recycle;

(e) means for replenishing fresh toner into said developing means;

(f) a toner concentration detection sensor disposed in said developing means for detecting magnetic permeability of the two-component developer in the developing means to detect a toner concentration of the developer;

(g) toner concentration control means for controlling toner concentration in accordance with the result of a comparison between a set reference signal and the detected toner concentration of the developer; and (h) drive control means for controlling operation of said image carrier, said developing means, said toner recycling means and said toner replenishing means, wherein when said toner concentration control means is set with an initial reference value, said drive control means includes a mode in which the operation of said toner replenishing means and said toner recycling means is stopped and the operation of said image carrier and said developing means is continued.

2. An image recording apparatus comprising:

(a) an image carrier for forming an electrostatic latent image thereon;

(b) developing means for developing the latent image with two-component developer composed of toner and carrier;

(c) cleaning means for removing residual toner from said image carrier;

(d) toner recycling means for feeding the toner removed by the cleaning means back to said developing means to recycle;

(e) means for replenishing fresh toner into said developing means;

(f) a toner concentration detection sensor disposed in said developing means for detecting magnetic permeability of the two-component developer in the developing means to detect a toner concentration of the developer;

(g) toner concentration control means for controlling toner concentration in accordance with the result of a comparison between a set reference signal and the detected toner concentration of the developer; and (h) drive control means for controlling operation of said image carrier, said developing means and said toner recycling means, wherein after said developing means has repeatedly conducted an image formation process a predetermined number of times so that developer inside the developing means is reduced, said drive control means inhibits the image formation process, conducts a forcible idling operation for a predetermined period of time by operating said image carrier, said developing means and said toner recycling means so that said toner recycling means recycles toner into said developing means, and sets a reference signal of said toner concentration control means after the forcible idling operation is completed.

3. The image recording apparatus of claim 2, wherein said drive control means restores the image formation process after the forcible idling operation is completed, and displays a signal indicating that the reference signal of said toner concentration control means cannot be set when the developer requires replacement.

4. An image recording apparatus comprising:

(a) an image carrier for forming an electrostatic latent image thereon;

(b) developing means for developing the latent image with two-component developer composed of toner and carrier;

(c) cleaning means for removing residual toner from said image carrier;

(d) toner recycling means for feeding the toner removed by the cleaning means back to said developing means to recycle;

(e) means for replenishing fresh toner into said developing means;

(f) a toner concentration detection sensor disposed in said developing means for detecting magnetic permeability of the two-component developer in the developing means to detect a toner concentration of the developer;

(g) toner concentration control means for controlling toner concentration in accordance with the result of a comparison between a set reference signal and the detected toner concentration of the developer; and (h) drive control means for controlling operation of said image carrier, said developing means and said toner recycling means, wherein after operation of the image recording apparatus is turned on and said developing means has repeatedly conducted an image formation process a predetermined number of times so that developer inside the developing means is reduced, said drive control means conducts a forcible idling operation for a predetermined period of time by operating said image carrier, said developing means and said toner recycling means so that said toner recycling means recycles toner into said developing means, and sets a reference signal of said toner concentration control means after the forcible idling operation is completed.

5. An image recording apparatus comprising:

(a) an image carrier for forming an electrostatic latent image thereon;

(b) developing means for developing the latent image with two-component developer composed of toner and carrier;

(c) cleaning means for removing residual toner from said image carrier;

(d) toner recycling means for feeding the toner removed by the cleaning means back to said developing means to recycle;

(e) means for replenishing fresh toner into said developing means;

(f) a toner concentration detection sensor disposed in said developing means for detecting magnetic permeability of the two-component developer in the developing means to detect a toner concentration of the developer;

(g) toner concentration control means for controlling toner concentration in accordance with the result of a comparison between a set reference signal and the detected toner concentration of the developer; and (h) drive control means for controlling operation of said image carrier, said developing means and said toner recycling means, wherein after said developing means has repeatedly conducted an image formation process a predetermined number of times so that developer inside the developing means is reduced, said drive control means conducts a forcible idling operation for a predetermined period of time by operating said image carrier, said developing means and said toner recycling means at predetermined intervals for a predetermined period of time so that said toner recycling means recycles toner into said developing means, and sets a reference signal of said toner concentration control means after the forcible idling operation is completed.

* * * * *